US005494734A

United States Patent [19]

Widders

[11] Patent Number: 5,494,734

[45] Date of Patent: Feb. 27, 1996

[54] TECHNIQUE FOR BEADED DECORATIVE ARTICLE

[76] Inventor: Cat A. Widders, 1910 Pacheco Blvd., Martinez, Calif. 94553

[21] Appl. No.: 182,426

[22] Filed: Jan. 18, 1994

[51] Int. Cl.[6] ..... D03D 9/00

[52] U.S. Cl. ..... 428/255; 428/11

[58] Field of Search ..... 428/12, 255, 256, 428/11

[56] References Cited

U.S. PATENT DOCUMENTS

| | | | |
|---|---|---|---|
| 2,102,746 | 12/1937 | Reilly | 428/255 X |
| 3,546,055 | 12/1970 | Spertus | 428/52 |
| 3,708,862 | 1/1973 | Powell, Jr. | 63/2 X |
| 4,016,183 | 4/1977 | Wallach | 428/542.8 |
| 4,075,962 | 2/1978 | Mabry | 112/439 |
| 4,530,665 | 7/1985 | Colonel | 112/439 X |
| 4,858,544 | 8/1989 | Bridge | 112/439 X |

*Primary Examiner*—Henry F. Epstein

*Attorney, Agent, or Firm*—Philip H. Albert; Townsend and Townsend and Crew

[57] ABSTRACT

A method of stitching beads into a flexible mesh fabric having evenly spaced and uniform square openings, more or less, with design printed thereon. The thread is attached to the mesh, so that beads of various color and finish to complete the design may be stitched in a way to secure them within the mesh. This is accomplished by the threaded needle being passed through a number of beads which will comprise all or part of a column of openings within the design. The beads are then individually pushed through the mesh openings and secured by the thread being brought through the mesh and carried back through the beads a second time, thereby trapping the mesh fabric between the two threads.

5 Claims, 3 Drawing Sheets

TECHNIQUE FOR BEADED DECORATIVE ARTICLE

BACKGROUND OF THE INVENTION

This invention relates to a method of stitching beads into a multi-colored, printed needlework canvas mesh, and also to a kit for carrying out this method, and for completing a decorative beaded article.

Do it yourself needlepoint kits employing a printed design on a canvas-like open mesh material have been available for many years. These kits utilize yarn or threads (such as embroidery floss) and a tapestry or large embroidery needle. The kits contain a printed needlepoint canvas with the design serving as a guideline, colored yarns which match or closely match the colors printed on the canvas, a tapestry needle, and instructions for completing the design. When complete, the design is covered by the yarn, which has been stitched over the canvas using various styles of stitches such as bargello, brick or basketweave.

Do it yourself cross stitch kits are also popular, where threads are stitched onto fabric such as muslin or aida cloth, over the pattern. The printed pattern is not normally left uncovered. Sometimes beads are stitched individually onto the base material, usually in a diagonal stitch, holding the bead above the base material, and using the bead as additional decoration, incidental to the pattern and stitchwork.

There are several techniques currently used for making beaded projects where the beads are strung, woven on a loom, or attached one at a time to each other. In all of these techniques, the beads abut one another and the design is created in total by the beads. The strength and durability is determined by the thread used to attach the beads. There is also no fabric extending beyond the beadwork to assist in mounting or attaching to other articles.

SUMMARY OF THE INVENTION

It is an object of this invention to provide a technique for making a beaded needlework piece.

Another object of this invention is to provide a decorative beaded article.

Said article is produced by threading a length of thread and knotting onto a printed sheet of strong mesh, such as interwoven cotton, or bonded plastic mesh. The needle is passed through the first opening used to the under side of the fabric.

Beads are strung according to the color printed around each space for the first column in the pattern, and each bead is pushed through its corresponding opening in the canvas so that each opening is holding one bead. The needle is fed through the canvas in the space immediately above the last space used for a bead, then passed back through each of the beads. There should now be a thread running through the beads on the bottom, and a thread running through the same beads on the top of the mesh.

The needle is inserted diagonally under the right corner of the column of beads, so that it comes back up to the top of the mesh in the first hole of the next column in the pattern. Feeding the needle back down to the underside of the canvas below the printed area, beads are threaded onto the needle for the next column. The process is continued, tying off and starting new threads when needed. The loose ends of thread are concealed by feeding the tail through a line of beads already interwoven into the mesh.

When the beading is complete, the beads will be intertwined within the openings of the mesh used, and the overall pattern will be achieved by the printed canvas and beads working in cooperation.

Once the beading is complete, the resulting piece of beadwork is used within a larger project such as a checkbook cover, coin purse, evening bag, etc.

DETAILED DESCRIPTION OF THE PREFERRED EMBODIMENTS

Figure 1:
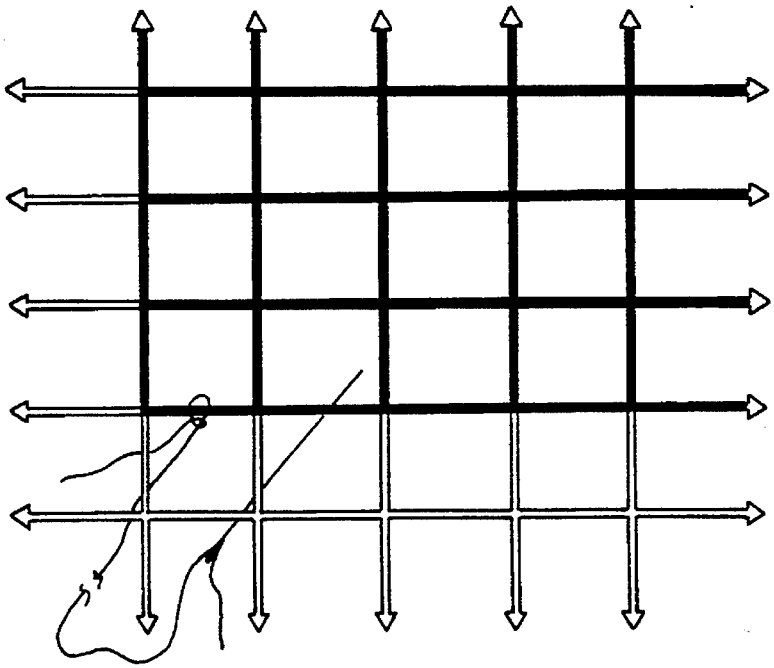
FIG. 1: Enlarged front view of canvas with thread attached at base of column of interstices. The darkened area is the pattern area and is printed in color.
Figure 3:
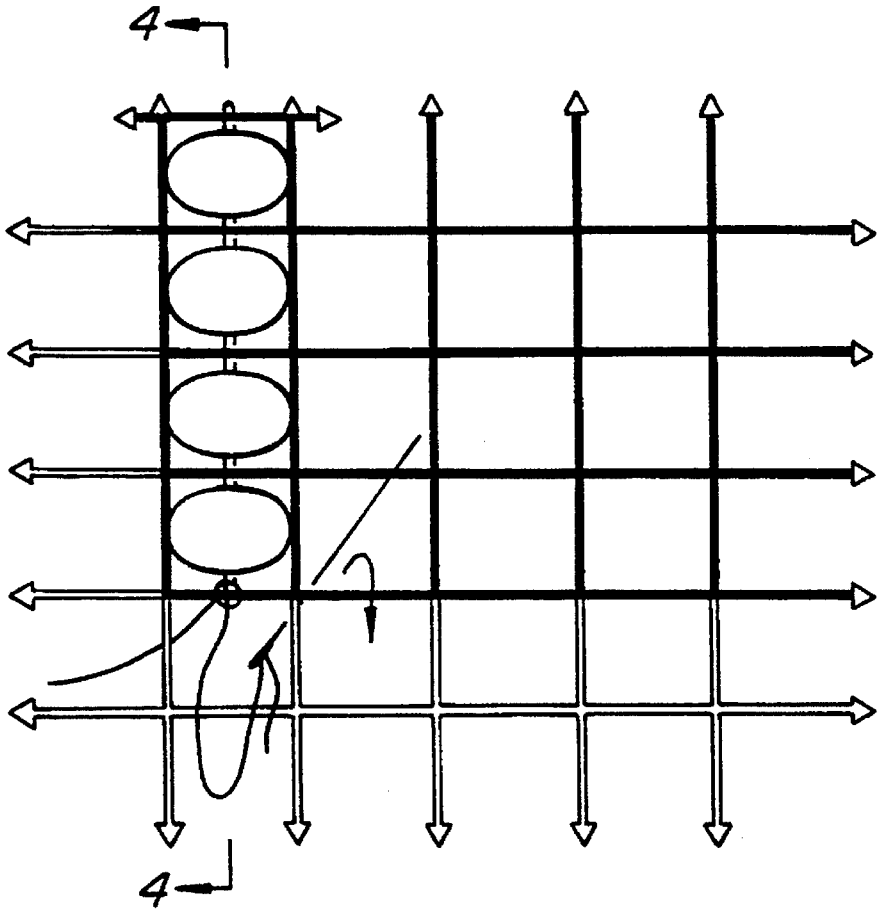
FIG. 3: Enlarged front view of canvas with first column of beads secured with both top and bottom threads, and showing the path of the needle anchoring the first column and continuing to the commencement of the next adjacent column.
Figure 4:
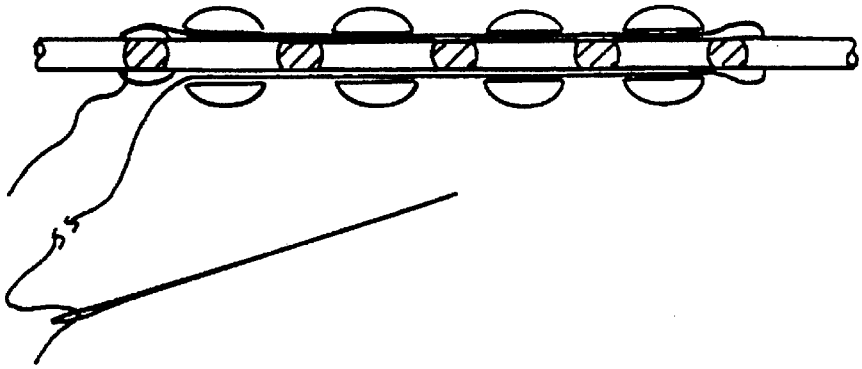
FIG. 4: Cross-section of row of beads indicating that the thread is passed through the holes of each of the beads, passed through canvas in the first of the spaces beyond the design area, and passing once again through the holes in each of the beads.
Figure 5:
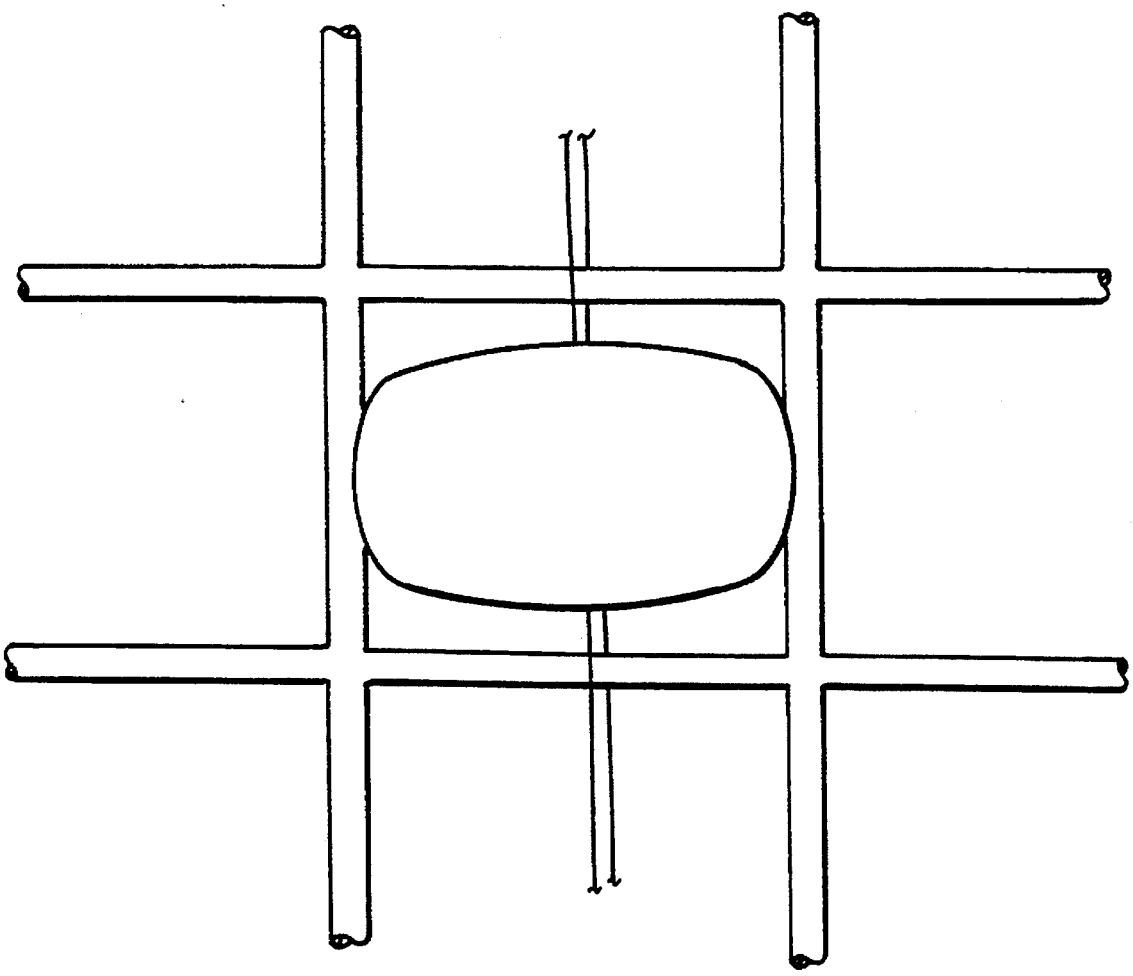
FIG. 5: Enlarged front view of a single bead and canvas opening, showing that the bead is slightly wider than the aperture of the canvas. This allows the bead to rest within the canvas without falling back through the canvas, and without being so large as to cause stretching or buckling of the canvas as the beads are worked.

The physical components necessary for carrying out this technique are:

A base fabric as shown enlarged in FIG. 1. This is a sheet of regular, pliable open material, such as needlepoint or bonded plastic mesh. Filaments should be bonded or interengaged to inhibit raveling or shifting of the horizontal and vertical fiber strands. Said fabric may be printed with a pattern in colors complementing or corresponding to the colors of beads being interwoven into the interstices of the mesh. When printed, the article design is a sum of the print and beads. The interstices of the base fabric are of a size to hold frictionally the beads without stretching or warping as shown in the enlarged FIG. 5;

A binding thread of appropriate size and fabric to carry the beads and affix them intertwined within the interstices of the mesh base as shown in FIGS. 3 and 4;

A needle capable of being passed through the beads when threaded and when a first binding thread has already been interwoven through the beads; and Beads in a multiplicity of colors and finishes as required to complete the design.

The technique is carried out in the following manner:

A length of beading thread is threaded through a beading needle. The tail of the thread is knotted securely to the bottom of the pattern, leaving 3 to 4 inches behind the knot. The needle is passed through an adjacent opening to the under side of the fabric.

Beads are strung according to predominant color on the horizontal and vertical filaments surrounding each of the interstices forming an upward column, starting with the opening directly above the knotted thread, and continuing with each bead corresponding to the next adjacent opening.

Figure 2:
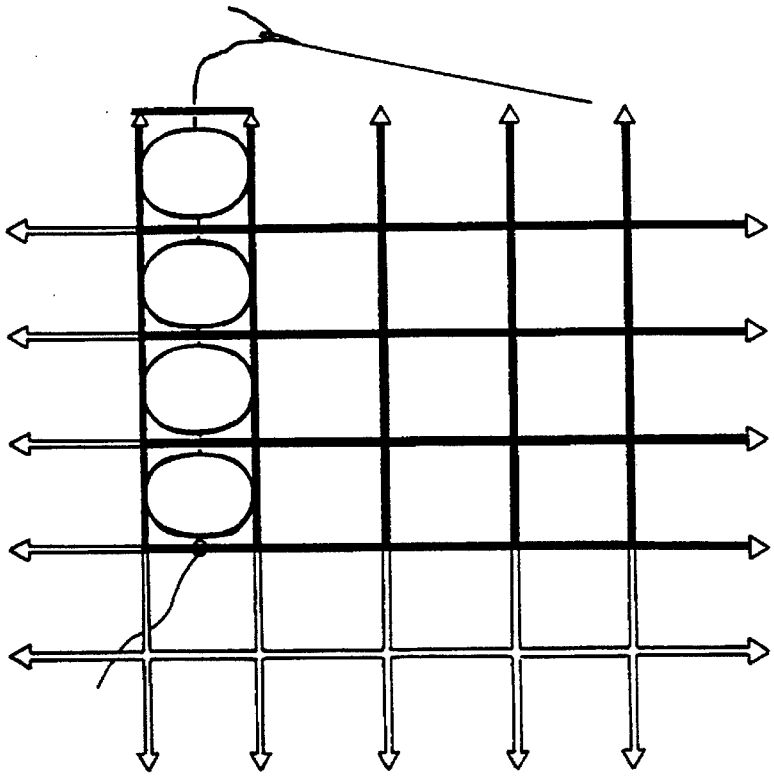
FIG. 2: Enlarged front view of canvas after beads have been threaded and each bead has been pushed through the canvas in its proper position.

When the line of beads are strung, each bead is inserted through its corresponding adjacent space in the canvas so that each opening is holding one bead, and the beads are frictionally secured slightly above the canvas as shown in FIG. 2. The needle is fed through the canvas in the opening immediately above the last opening used for a bead, then passed back through the channel in each of the beads in the column as shown in FIGS. 3 (top view) and 4 (cross-section). There should now be a thread running through the channels of the beads on the underneath side from bottom to top, and a thread running through the same channels on the top side of the mesh from top to bottom.

The needle is inserted diagonally under the intersection of the horizontal and vertical axes of filaments, so that it travels under the top intersection to the right of the current column, and comes up through the first aperture of the next column to the right as shown by the path of the needle in FIG. 3. Feed the needle back down to the underside of the canvas, on the lower side of the horizontal filament as indicated by the directional arrow in FIG. 3.

Picking up beads for the next column, the process is continued as above, until the thread is shorter than twice the height of the design plus 2 to 3 inches. At this point the thread in use must be secured and concealed, and a new thread started.

The thread is securely to the canvas by knotting to the adjacent horizontal filament. The remaining line of thread is then fed back through the line of beads to the left of the last line strung in order to conceal the end.

A new length of thread is cut, and the needle threaded. The needle is passed through the channel formed by the aligned holes in the beads engaged in the last column worked. The thread is secured at the bottom with a knot, the beading is continued in the next column following the pattern as in the instructions above, until the entire pattern area is filled with beads.

What is claimed is:

1. A beaded article, comprising:

a body of mesh material, said mesh material defining a grid of openings therein;

a plurality of beads positioned within said grid of openings, including at least one plurality of aligned beads arranged in a line;

at least two beading threads passing through each of said plurality of aligned beads, one of said at least two beading threads passing through said plurality of aligned beads on one side of said body of mesh material, and another of said at least two beading threads passing through said plurality of aligned beads on an opposite side of said body of mesh material.

2. The beaded article of claim 1, wherein said plurality of beads are beads of various colors and are positioned to form a design.

3. The beaded article of claim 1, wherein said mesh material is patterned to suggest an image or pattern.

4. The beaded article of claim 1, wherein said plurality of beads and said mesh material together form an image or pattern.

5. A beaded article, comprising:

a body of mesh material, said mesh material defining a grid of openings therein;

a plurality of beads positioned within said grid of openings;

at least two beading threads passing through each of said plurality of beads, one of said at least two beading threads passing through a plurality of beads on one side of said mesh material, and another of said at least two beading threads passing through said plurality of beads on an opposite side of said mesh material.

* * * * *